US005896761A

United States Patent [19]

Chen

[11] Patent Number: 5,896,761

[45] Date of Patent: Apr. 27, 1999

[54] PADLOCK

[76] Inventor: Waterson Chen, 8F, No. 428, Wu-Chuan-Nan Rd., Taichung City, Taiwan

[21] Appl. No.: 09/112,045

[22] Filed: Jul. 8, 1998

[51] Int. Cl.[6] ..... E05B 67/22

[52] U.S. Cl. ..... 70/38 A; 70/367; 70/386; 70/371

[58] Field of Search ..... 70/38 A, 38 R, 70/386, 370, 371, 367, 368, 416, 417

[56] References Cited

U.S. PATENT DOCUMENTS

| | | | |
|---|---|---|---|
| 1,660,903 | 2/1928 | Adamson | 70/38 A |
| 1,824,301 | 9/1931 | Russell | 70/38 A |
| 2,141,748 | 12/1938 | Hansen | 70/38 A |
| 2,460,615 | 2/1949 | Andrew | 70/38 A X |
| 2,482,177 | 9/1949 | Harbison | 70/38 A |
| 3,068,682 | 12/1962 | Russell et al. | 70/38 A |
| 3,117,437 | 1/1964 | Russell et al. | 70/38 A |
| 3,172,279 | 3/1965 | Patriquin | 70/38 A |
| 3,423,969 | 1/1969 | Foote | 70/38 A |
| 3,855,824 | 12/1974 | Falk | 70/38 A |
| 4,098,100 | 7/1978 | Watt | 70/38 A |
| 4,138,868 | 2/1979 | Richards, Sr. | 70/38 A |
| 4,763,496 | 8/1988 | Evans et al. | 70/38 A |
| 4,811,578 | 3/1989 | Masoncup et al. | 70/38 A |
| 4,838,051 | 6/1989 | Yang | 70/38 A |
| 4,938,039 | 7/1990 | Tzung-I | 70/38 A |
| 4,998,422 | 3/1991 | Borgmann et al. | 70/38 A |
| 5,174,136 | 12/1992 | Thwing | 70/38 A |
| 5,377,511 | 1/1995 | Meckbach | 70/38 A |

FOREIGN PATENT DOCUMENTS

| | | | |
|---|---|---|---|
| 3126035 | 1/1983 | Germany | 70/38 A |

*Primary Examiner*—Suzanne Dino Barrett
*Attorney, Agent, or Firm*—Merchant, Gould, Smith, Edell, Welter & Schmidt

[57] ABSTRACT

A padlock includes a lock base formed with first and second shackle insert holes, a lock receiving space which is disposed between the first and second shackle insert holes and which has an upper section communicated with the second shackle insert hole, and a ball chamber which extends transversely between the first shackle insert hole and the upper section of the lock receiving space. A lock device is received in the lock receiving space, and has an axially rotatable key-operated lock core which is provided with a plunger formed with a latch projection. A locking unit includes at least one ball member rollingly disposed in the ball chamber adjacent to the plunger. A shackle has longer and shorter leg portions to be received in the first and second shackle insert holes, respectively. The shorter leg portion is formed with a plunger engaging groove for engaging the latch projection of the plunger. The longer leg portion is formed with a ball retaining groove for engaging the locking unit. A biasing spring is disposed in the first shackle insert hole for biasing the longer leg portion upwardly.

3 Claims, 10 Drawing Sheets

PADLOCK

BACKGROUND OF THE INVENTION

1. Field of the Invention

This invention relates to a padlock, more particularly to a padlock having a lock device that is suitable for use with lock bases of different sizes.

2. Description of the Related Art

FIG. 1 illustrates a conventional padlock which includes a lock base 10, a lock device 11, two ball members 12, and a U-shaped shackle 13. The lock base 10 is formed with two shackle insert holes 16 for receiving longer and shorter leg portions of the shackle 13, a lock receiving space 14 between the shackle insert holes 16 for receiving the lock device 11, and two ball chambers 15 on opposite sides of an upper section of the lock receiving space 14 to communicate the lock receiving space 14 with the shackle insert holes 16, respectively. The lock device 11 is formed with an engaging rim 111 for retaining the lock base 10 in the lock receiving space 14. The lock device 11 has an upper end formed with a plunger 112 which has two opposite latch portions 113 for actuating the ball members 12, respectively. When the padlock is in a locking state, the ball members 12 are pushed by the latch portions 113 of the plunger 112 to extend into the shackle insert holes 16 for engaging ball retaining grooves 131 formed in the longer and shorter leg portions of the shackle 13 in order to prevent upward movement of the shackle 13 and removal of the shorter leg portion from the corresponding shackle insert hole 16. When the lock device 11 is operated using the correct key (not shown) to rotate a lock core (not shown) in the lock device 11, the plunger 112 is rotated to permit retraction of the ball members 12 into the ball chamber 15 for disengaging the shackle 13, thereby permitting upward movement of the shackle 13 and removal of the shorter leg portion from the corresponding shackle insert hole 16 for placing the padlock in an unlocked state.

In the conventional padlock, when it is required to produce a lock base with a different size, such as a different width, the original lock device cannot be used, and a new lock device with a different size is produced so as to fit the lock base. Since a lock device generally has a relatively complicated and delicate structure in order to provide a good antitheft effect, the design and manufacture of a new lock device result in great expense.

In applicant's co-pending U.S. patent application Ser. No. 08/992,444, filed on Dec. 17, 1997 and entitled "PADLOCK WITH REPLACEABLE KEY-OPERATED LOCK CORE," there is disclosed a padlock which includes a lock base, a lock unit, a shackle, and catch means. The lock base is formed with first and second shackle insert holes for receiving longer and shorter leg portions of the shackle, and a lock receiving space between and parallel to the first and second shackle insert holes for receiving the lock unit. The lock receiving space has an upper section formed as a catch chamber which extends between the shackle insert holes for receiving the catch means. The lock unit includes an axially rotatable key-operated lock core having a plunger disposed in the catch chamber. The second shackle insert hole has an innermost end provided with a spring-loaded retaining means which extends radially into the lock receiving space to engage a peripheral portion of the lock unit so as to retain releasably the lock unit in the lock receiving space. The catch means includes first and second catch units, each of which is provided with a ball member, and a spring for pulling together the catch units such that the ball members engage the plunger. When the plunger is in the locking position, the plunger forces apart the first and second catch units so as to extend the ball members into the shackle insert holes such that the ball members engage the longer and shorter leg portions of the shackle, respectively. When the lock unit is operated using the correct key to cause axial rotation of the plunger, the plunger ceases to force apart the first and second catch units, thereby retracting the first and second catch units into the catch chamber by virtue of the spring in order to permit upward movement of the longer leg portion and removal of the shorter leg portion from the second shackle insert hole. After the shorter leg portion has been removed from the second shackle insert hole of the lock base, the longer leg portion can be rotated to expose the second shackle insert hole. In this situation, a tool can be inserted into the second shackle insert hole so as to access and actuate the retaining means for disengaging the latter from the locking unit, thereby permitting removal of the lock unit from the lock receiving space for replacement purposes.

SUMMARY OF THE INVENTION

The main object of the present invention is to provide a padlock having a lock device that is suitable for use with lock bases of different sizes.

Accordingly, the padlock of the present invention includes a lock base, a lock device, a locking unit, a shackle, and a biasing spring. The lock base has top and bottom sides, and is formed with first and second shackle insert holes which extend from the top side toward the bottom side. The first shackle insert hole has a length longer than that of the second shackle insert hole. The lock base is further formed with a lock receiving space which extends from the bottom side toward the top side and which is disposed between the first and second shackle insert holes. The lock receiving space has an upper section communicated with the second shackle insert hole. The lock base is further formed with a ball chamber which extends transversely between the first shackle insert hole and the upper section of the lock receiving space. The lock device is received in the lock receiving space, and has an axially rotatable key-operated lock core which is provided with a plunger that is disposed in the upper section of the lock receiving space. The plunger is formed with a latch projection. The locking unit includes at least one ball member rollingly disposed in the ball chamber adjacent to the plunger. The shackle has a longer leg portion which is retained slidably and rotatably in the first shackle insert hole, and a shorter leg portion which is received removably in the second shackle insert hole. The shorter leg portion is formed with a plunger engaging groove for engaging the latch projection of the plunger. The longer leg portion is formed with a ball retaining groove for engaging the locking unit. The biasing spring is disposed in the first shackle insert hole and biases the longer leg portion upwardly. The lock core is rotatable so as to rotate the plunger between a locking position, in which the latch projection of the plunger engages the plunger engaging groove in the shorter leg portion and in which the locking unit engages the ball retaining groove in the longer leg portion to arrest upward movement of the longer and shorter leg portions against action of the biasing spring in order to prevent removal of the shorter leg portion from the second shackle insert hole, and an unlocking position, in which the latch projection is disengaged from the plunger engaging groove in the shorter leg portion, and the longer leg portion is moved relative to the locking unit due to the action of the biasing spring for disengaging the locking unit, thereby permitting removal of the shorter leg portion from the second shackle insert hole.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
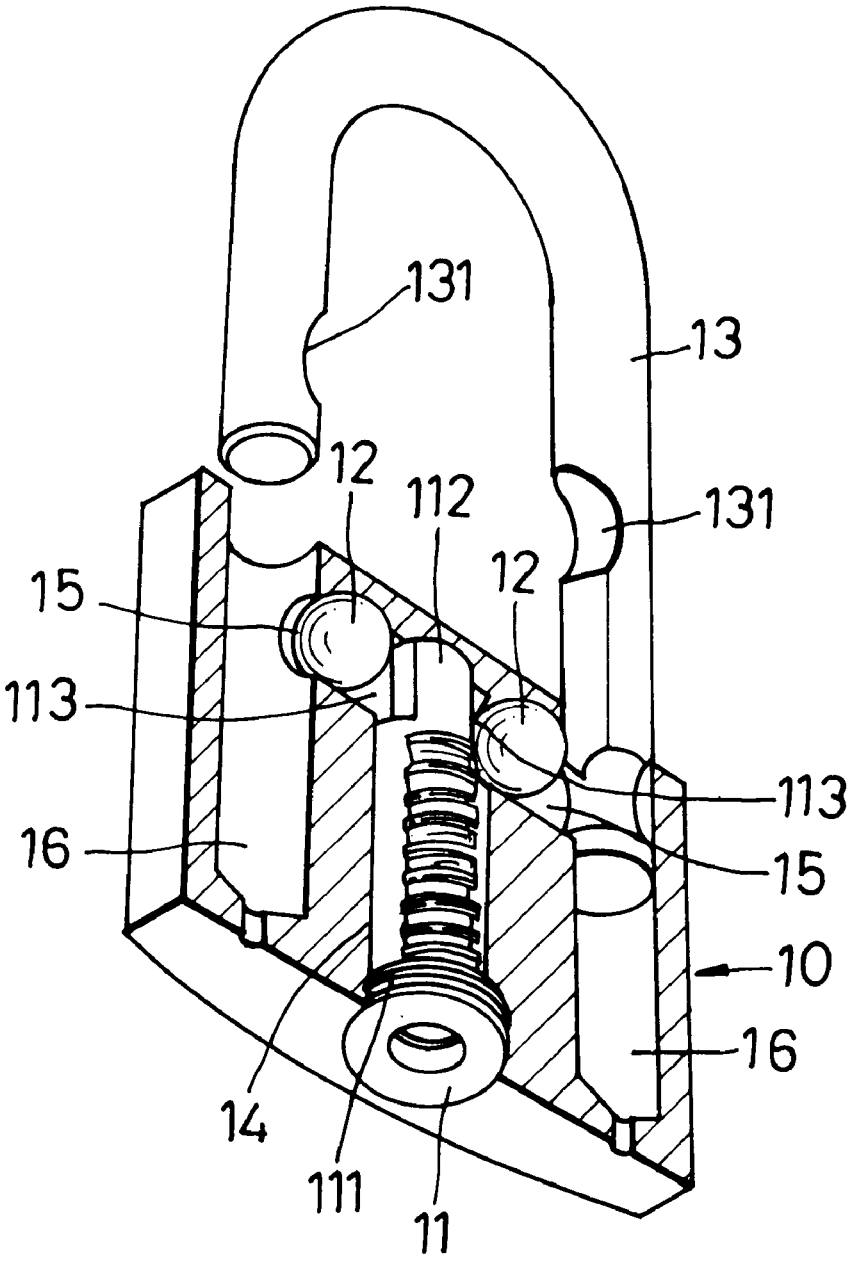
FIG. 1 PRIOR ART
FIG. 1 is a partly-sectional, perspective view of a conventional padlock.
Figure 2:
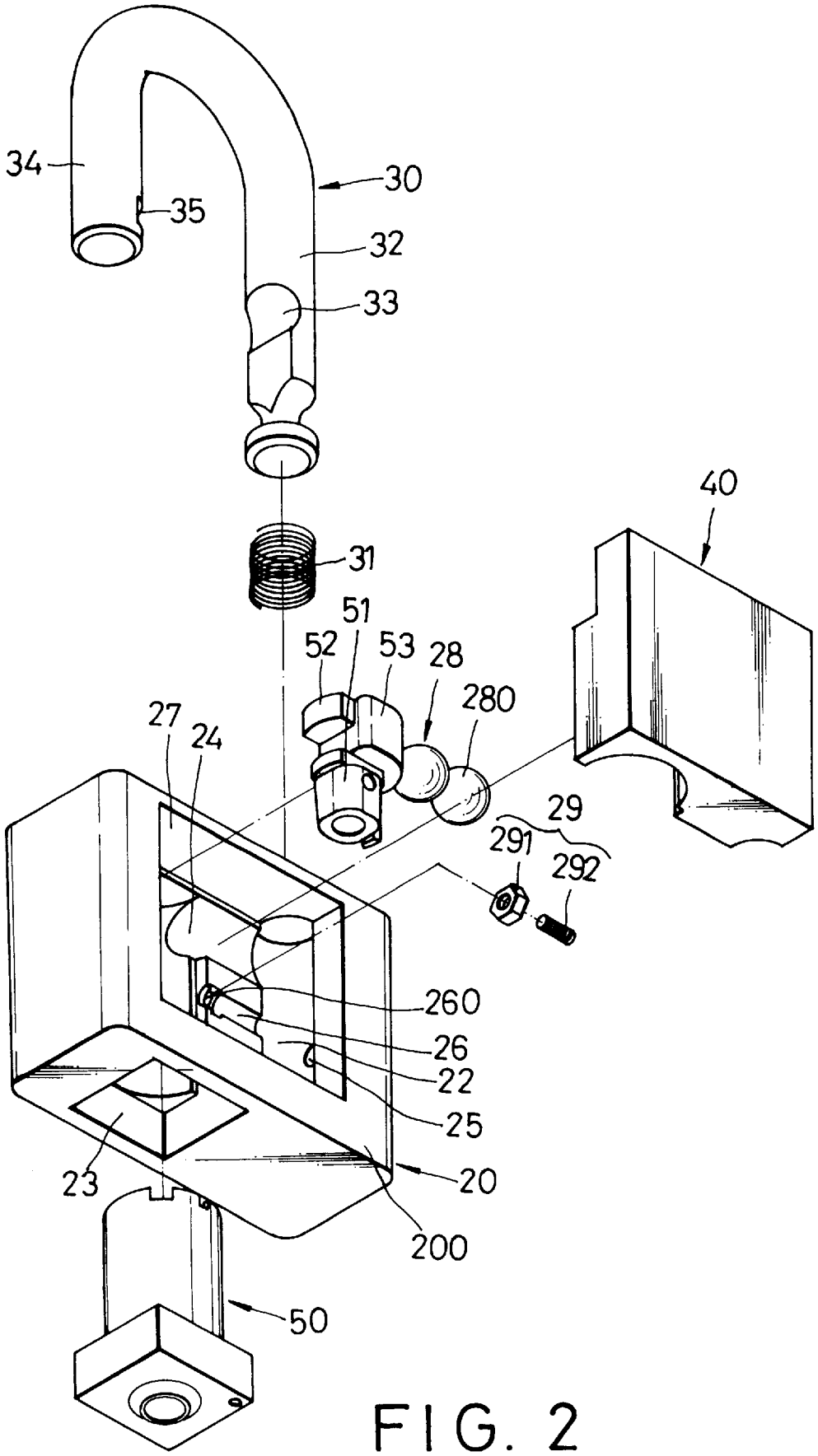
FIG. 2 is an exploded perspective view of a first preferred embodiment of a padlock according to the present invention.
Figure 3:
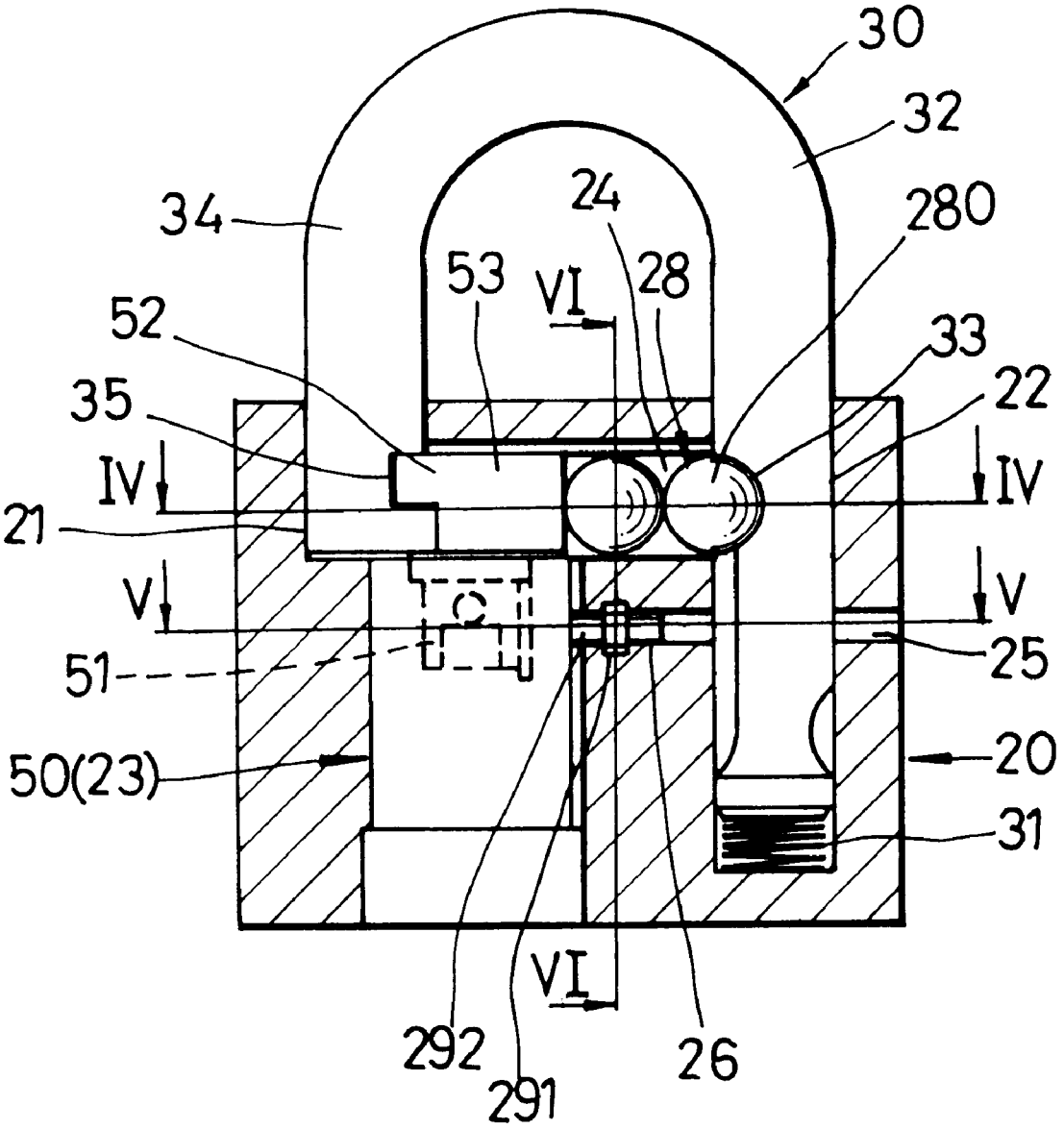
FIG. 3 is a vertical sectional view of the first preferred embodiment when in a locking state.

Referring to FIGS. 2 and 3, the padlock of the first preferred embodiment according to the present invention is shown to include a lock base 20, a generally U-shaped shackle 30, a lock device 50, a locking unit 28, and a biasing spring 31.

The lock base 20 is formed from a body part 200 and a cover member 40 which is secured to the body part 200 at a front opening 27 of the latter, such as by welding. The lock base 20 is formed as a generally rectangular body with top and bottom sides, and is formed with spaced first and second shackle insert holes 22, 21 which extend from the top side toward the bottom side. The first shackle insert hole 22 has a length longer than that of the second shackle insert hole 21. The lock base 20 is further formed with a lock receiving space 23 which extends from the bottom side toward the top side and which is disposed between the first and second shackle insert holes 22, 21. The lock receiving space 23 has a rectangular lower section, and an upper section which is communicated with the second shackle insert hole 21. The lock base 20 is further formed with a ball chamber 24 which extends transversely between the first shackle insert hole 22 and the upper section of the lock receiving space 23, and a fastener hole 26 which extends between the first shackle insert hole 22 and the lock receiving space 23 below the ball chamber 24. The ball chamber 24 has a circular cross-section and a predetermined length for receiving the locking unit 28 that consists of a predetermined number of ball members 280 therein. The fastener hole 26 has a nut-retaining hole portion 260 with a hexagonal cross-section. The lock base 20 has a surrounding wall between the top and bottom sides and formed with an access bore 25 which extends into the first shackle insert hole 22 and which is aligned with the fastener hole 26.

The lock device 50 is received in the lock receiving space 23, and has a lower end formed as a rectangular head portion which is retained in the rectangular lower section of the lock receiving space 23. The lock device 50 is provided with an axially rotatable lock core 51 which has a plunger 53 that is disposed in the upper section of the lock receiving space 23. The plunger 53 is formed with a generally rectangular latch projection 52.

In this embodiment, the length of the ball chamber 24 is suitable for receiving a locking unit 28 which includes two ball members 280. The ball members 280 are rollingly disposed in the ball chamber 24 adjacent to the plunger 51.

The shackle 30 includes a longer leg portion 32 which is slidably and rotatably retained in the first shackle insert hole 22, and a shorter leg portion 34 which is received removably in the second shackle insert hole 21. The longer leg portion 32 has an inner side facing the shorter leg portion 34 and formed with a curved ball retaining groove 33 for engaging one of the ball members 280 of the locking unit 28 that is disposed immediately adjacent to the longer leg portion 32. The shorter leg portion 34 has an inner side facing the longer leg portion 32 and formed with a generally rectangular plunger engaging groove 35 for engaging the latch projection 52 of the plunger 53.

The biasing spring 31 is disposed in the first shackle insert hole 22 below the longer leg portion 32 for biasing the longer leg portion 32 upwardly.

Figure 5:
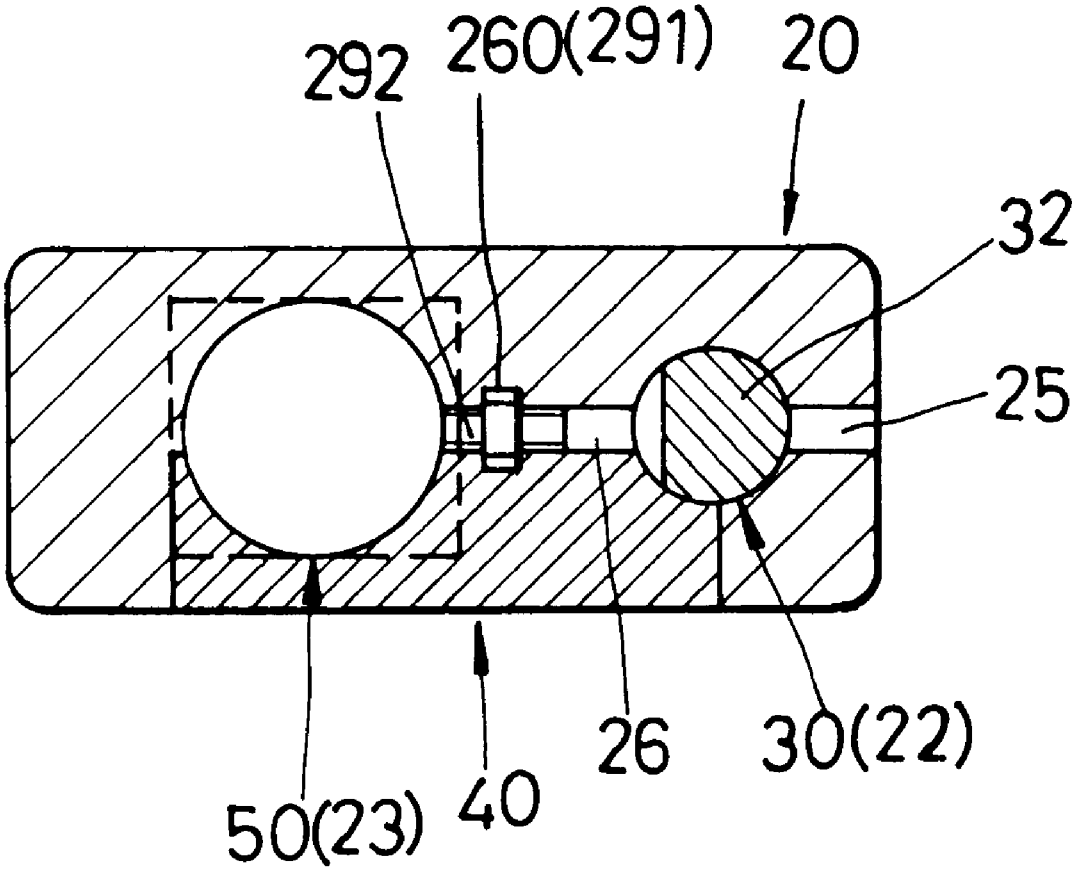
FIG. 5 is another horizontal sectional view of the first preferred embodiment, taken along line V—V in FIG. 3.
Figure 6:
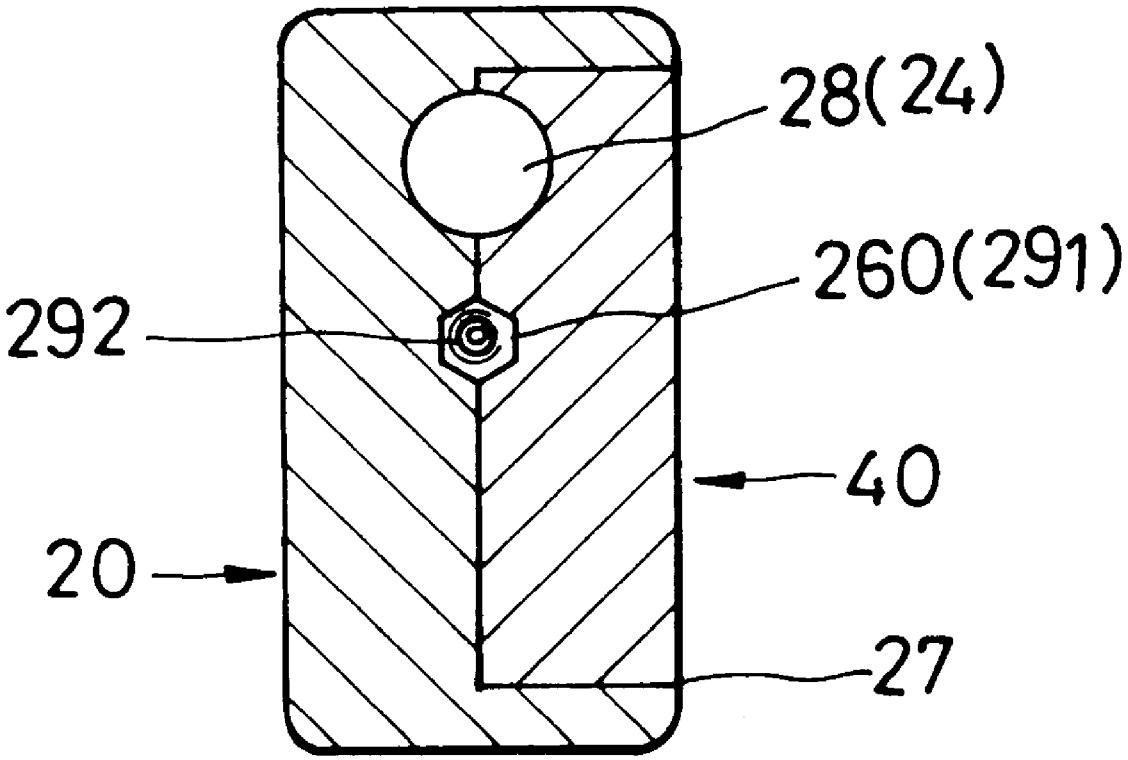
FIG. 6 is vertical sectional view of the first preferred embodiment, taken along line VI—VI in FIG. 3.

With further reference to FIGS. 5 and 6, the fastener unit 29 is disposed in the fastener hole 26 of the lock base 20, and includes a nut 291 retained in the nut-retaining hole portion 260 and a screw bolt 292 which extends threadedly through the nut 291 and which has one end abutting against a peripheral portion of the lock device 50 so as to prevent removal of the lock device 50 from the lock receiving space 23.

In assembly, the fastener unit 29 is placed in the fastener hole 26 of the lock base 20 before the cover member 40 is welded to the body part 200 of the lock base 20. Then, the biasing spring 31 is disposed in the first shackle insert hole 22, and the longer and shorter leg portions 32, 34 are extended into the first and second shackle insert holes 22, 21, respectively. Thereafter, the locking unit 28 is disposed in the ball chamber 24. The number of the ball members 280 required to form the locking unit 28 depends on the length of the ball chamber 24 formed in the lock base 20. In this embodiment, two ball members 2.80 are required. Finally, the lock device 50 with the lock core 51 mounted thereon is extended into the lock receiving space 23 from the bottom side of the lock base 20. In order to secure the lock device 50 to the lock base 20, a tool 100 is extended into the fastener hole 26 via the access bore 25 and through the first shackle insert hole 22 for operating the screw bolt 292 so that one end of the screw bolt 292 abuts against the lock device 50 to prevent removal of the latter from the lock receiving space 23. Operation of the screw bolt 292 by the tool 100 is conducted under the condition that the longer leg portion 32 is moved upwardly to expose the fastener hole 26. Assembly of the padlock is thus completed.

Figure 4:
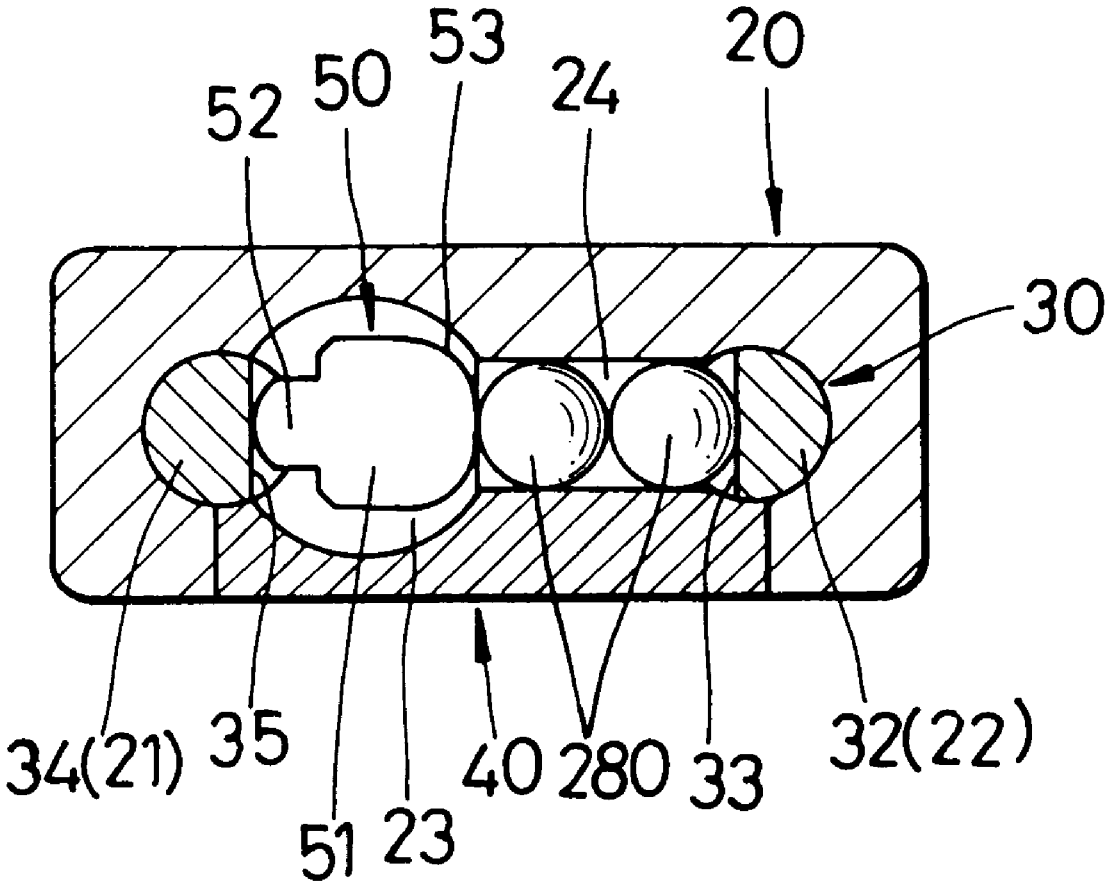
FIG. 4 is a horizontal sectional view of the first preferred embodiment, taken along line IV—IV in FIG. 3.

Referring to FIGS. 3 and 4, when the padlock is in a locking state, the latch projection 52 of the plunger 53 of the lock device 50 extends into the second shackle insert hole 21 to engage the plunger engaging groove 35 in the shorter leg portion 34 of the shackle 30, and one of the ball members 280 that is disposed immediately adjacent to the longer leg portion 32 engages the ball retaining groove 33 in the longer leg portion 32, thereby arresting upward movement of the longer and shorter leg portions 32, 34. Removal of the shorter leg portion 34 from the second shackle insert hole 21 is prevented at this time. The biasing spring 31 is compressed under this condition.

Figure 7:
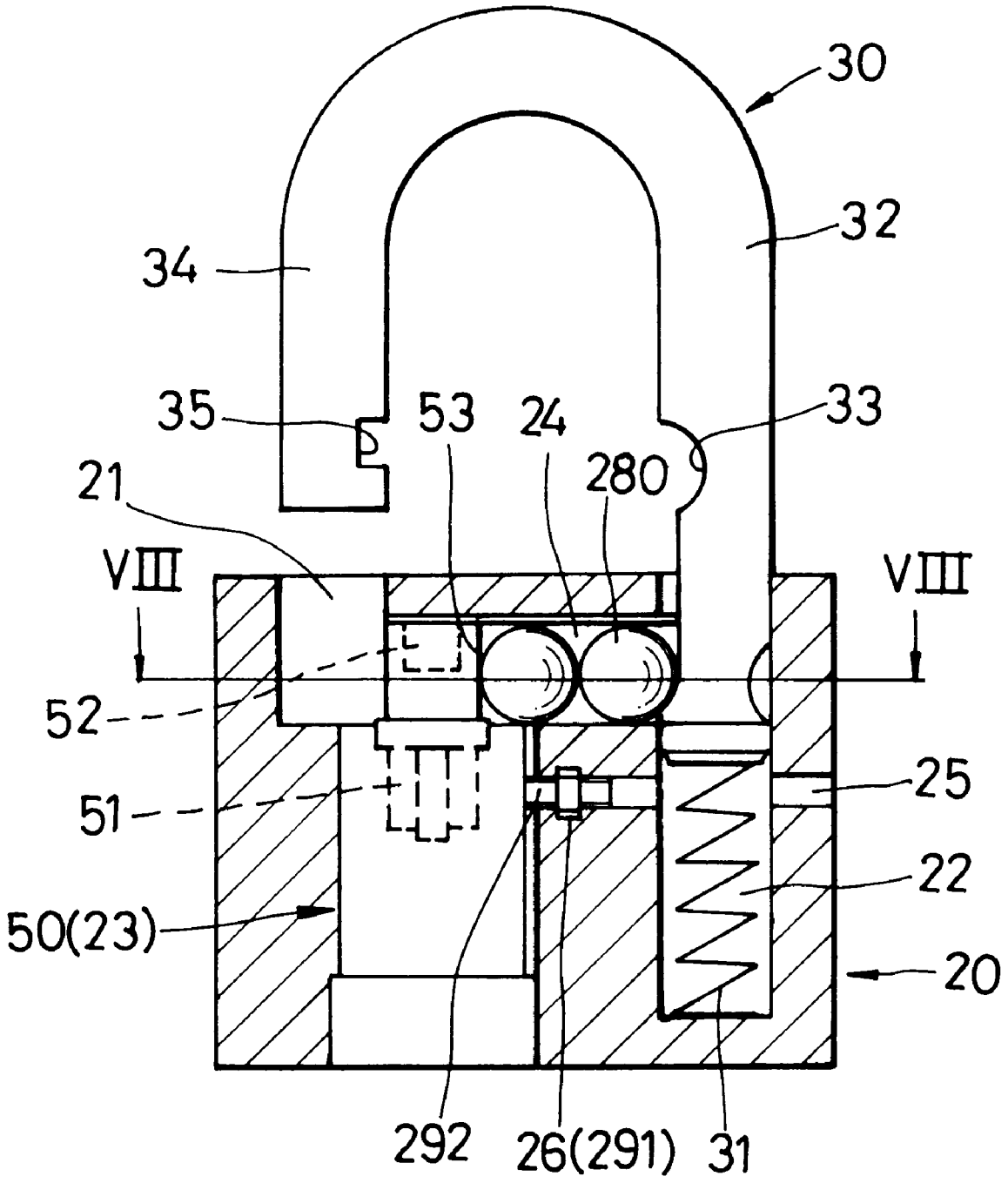
FIG. 7 a vertical sectional view of the first preferred embodiment when in an unlocking state.
Figure 8:
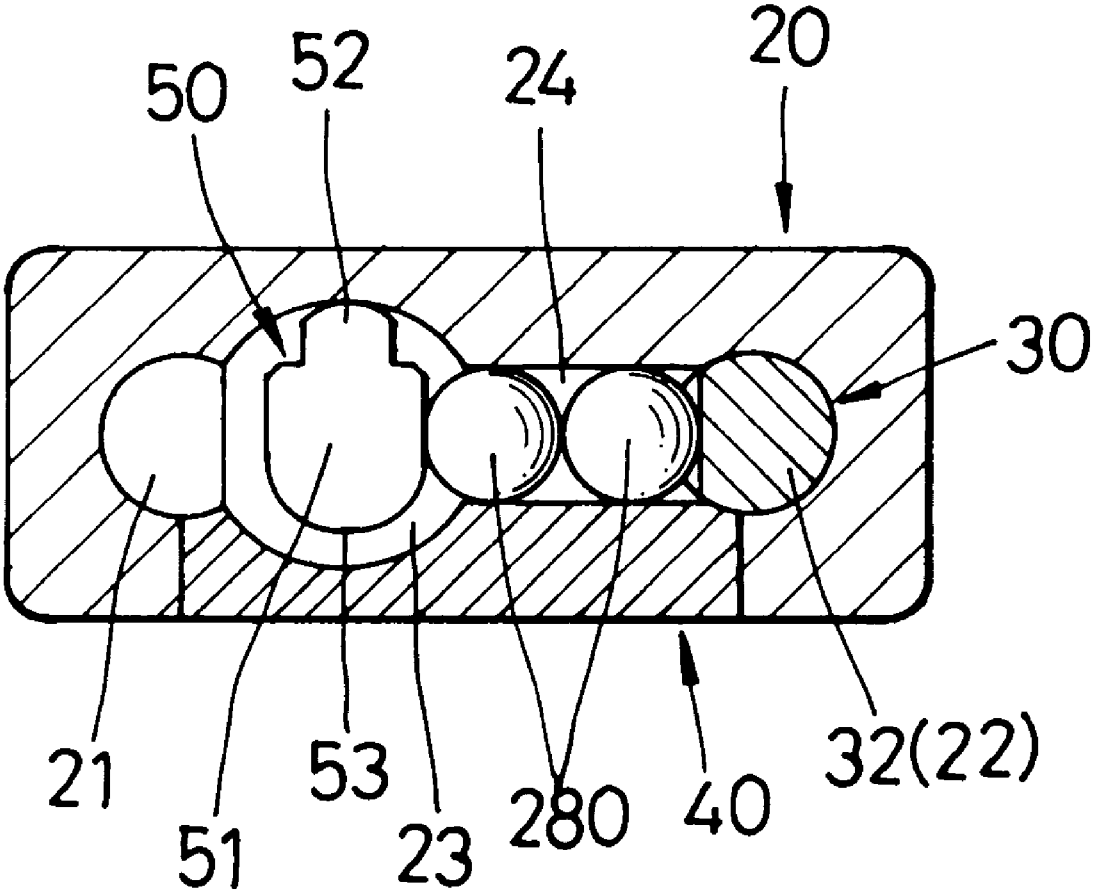
FIG. 8 a horizontal sectional view of the first preferred embodiment, taken along line VIII—VIII in FIG. 7.

Referring to FIGS. 7 and 8, when the lock device 50 is operated using the correct key (not shown) to result in axial rotation of the lock core 51 and the plunger 53, the latch projection 52 is moved away from the shorter leg portion 34 to disengage the plunger engaging groove 35, and the biasing spring 31 expands to move the longer leg portion 32 upwardly for disengaging the adjacent ball member 280 of the locking unit 28, thereby permitting removal of the shorter leg portion 34 from the second shackle insert hole 21 and placing the padlock in an unlocking state. It is noted that, when the padlock is in the unlocking state, the ball member 280 that is disposed adjacent to the longer leg portion 32 can engage a bottom end of the latter to prevent removal of the longer leg portion 32 from the first shackle insert hole 22, while permitting axial rotation of the longer leg portion 32 in the first shackle insert hole 22.

Figure 9:
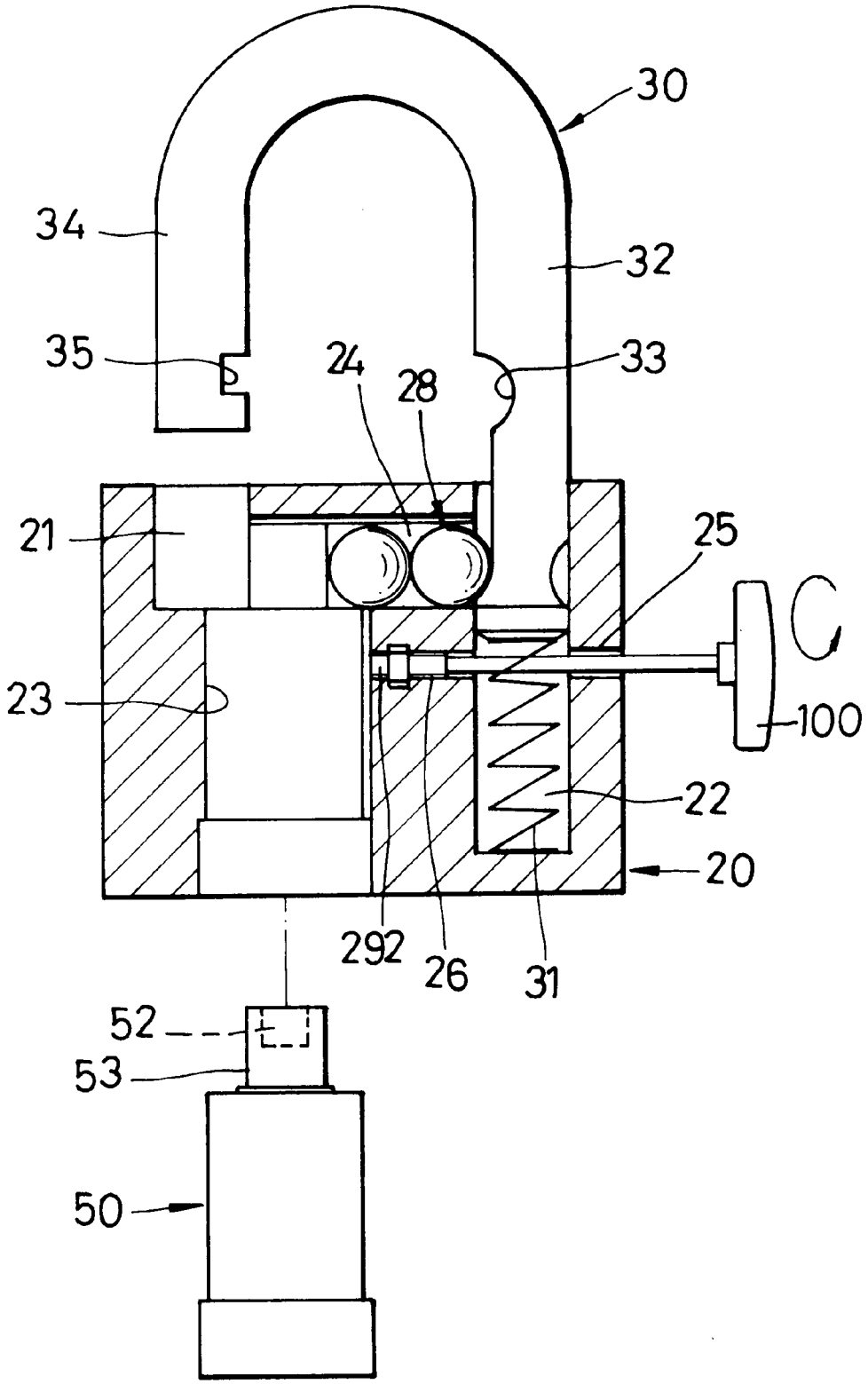
FIG. 9 a vertical sectional view illustrating how a lock device can be removed from a lock base of the padlock of the first preferred embodiment.

Referring to FIG. 9, the tool 100 is extendible into the fastener hole 26 via the access bore 25 only when the padlock is in an unlocking state. This is because the fastener hole 26 is blocked by the longer leg portion 32 to prevent access thereto when the padlock is in the locking state. As such, when it is desired to remove the lock device 50, such as for replacement with a new one, the lock device 50 is first operated using the correct key for disengaging the longer leg portion 32 from the locking unit 28 so that the longer leg portion 32 is moved upwardly by virtue of the biasing spring 31 to expose the fastener hole 26. The tool 100 is then extended into the fastener hole 26 to operate the screw bolt 292 so that the screw bolt 292 is moved away from the lock device 50 to permit removal of the lock device 50 from the lock receiving space 23. After a new lock device is placed in the lock receiving space 23, the screw bolt 292 is operated using the tool 100 to engage the new lock device.

Referring again to FIG. 3, when the padlock is in the locking state, it is noted that the lock device 50 can be prevented from being removed from the lock receiving space 23 even if the screw bolt 292 is loosened from the lock device 50 since the plunger 53 of the lock device 50 engages the shorter leg portion 34.

Figure 10:
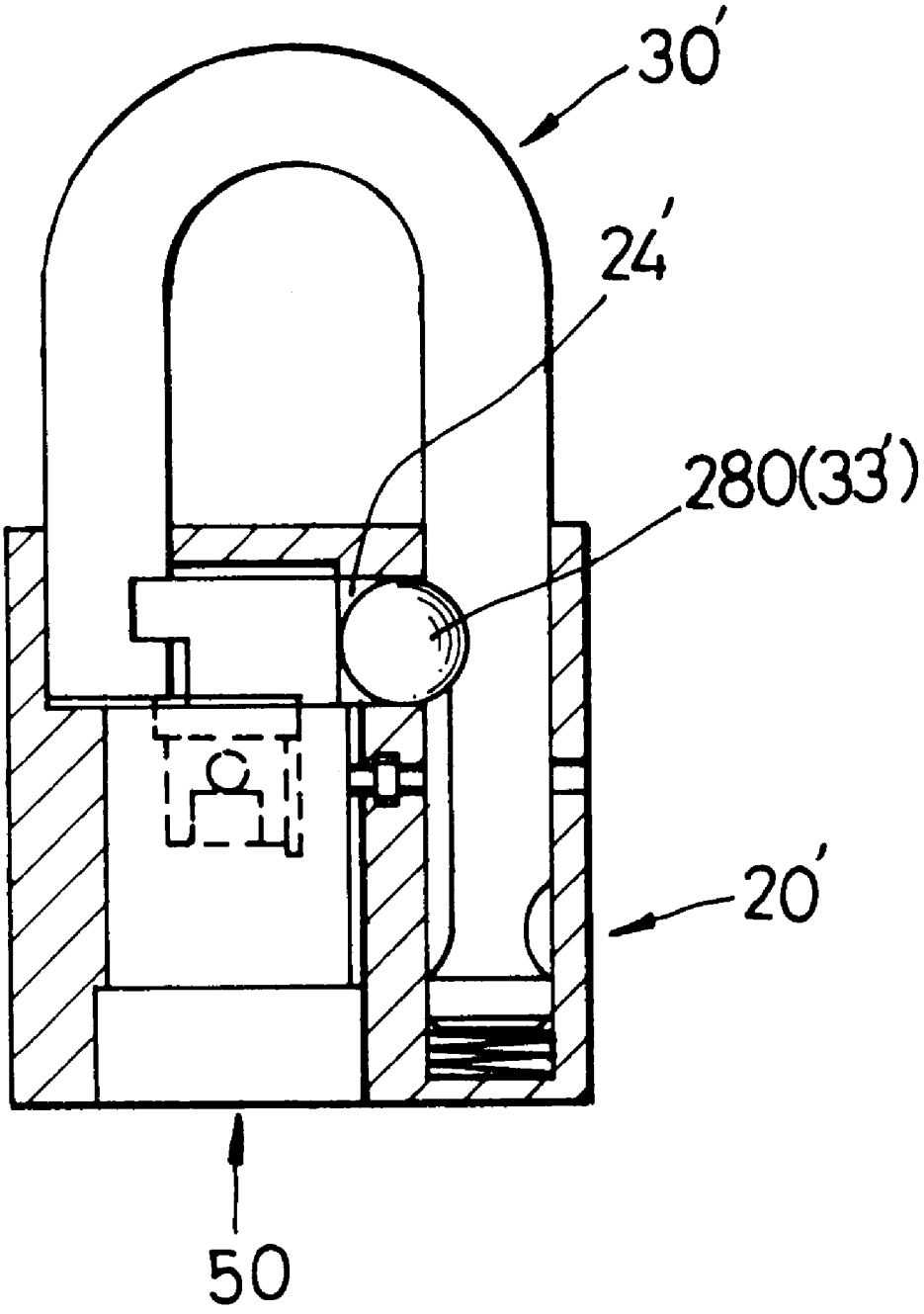
FIG. 10 is a vertical sectional view illustrating a padlock of a second preferred embodiment according to the present invention.

Referring to FIG. 10, the padlock of the second preferred embodiment according to the present invention is shown to include a lock base 20' which has a width shorter than that of the lock base 20 in the previous embodiment. In this situation, the length of the ball chamber 24' is shortened in accordance with the shorter width of the lock base 20', while the size of the lock receiving space is kept identical to that in the previous embodiment. Only one ball member 280 is installed in the ball chamber 24' for engaging the ball retaining groove 33' in the longer leg portion of the shackle 30'. The lock device 50 in the previous embodiment can be used in the lock base 20' of this embodiment.

According to the present invention, a lock device can be used with lock bases of different widths by modifying the number of ball members that constitute the locking unit to fit the length of the ball chamber. It is not necessary to design and manufacture a different lock device, which is relatively costly, in order to fit a lock base of a different width. The present invention thus results in cost-savings. Moreover, with a replaceable lock device, the padlock of this invention can provide an enhanced anti-theft effect.

With this invention thus explained, it is apparent that numerous modifications and variations can be made without departing from the scope and spirit of this invention. It is therefore intended that this invention be limited only as indicated in the appended claims.

I claim:

1. A padlock, comprising:

a lock base having top and bottom sides and formed with first and second shackle insert holes which extend from said top side toward said bottom side, said first shackle insert hole having a length longer than that of said second shackle insert hole, said lock base being further formed with a lock receiving space which extends from said bottom side toward said top side and which is disposed between said first and second shackle insert holes, said lock receiving space having an upper section communicated with said second shackle insert hole, said lock base being further formed with a ball chamber which extends transversely between said first shackle insert hole and said upper section of said lock receiving space;

a lock device received in said lock receiving space, said lock device having an axially rotatable key-operated lock core which is provided with a plunger that is disposed in said upper section of said lock receiving space, said plunger being formed with a latch projection;

a locking unit including at least one ball member rollingly disposed in said ball chamber adjacent to said plunger;

a shackle having a longer leg portion which is retained slidably and rotatably in the first shackle insert hole, and a shorter leg portion which is received removably in said second shackle insert hole, said shorter leg portion being formed with a plunger engaging groove for engaging said latch projection of said plunger, said longer leg portion being formed with a ball retaining groove for engaging said locking unit; and a biasing spring disposed in said first shackle insert hole for biasing said longer leg portion upwardly;

said lock core being rotatable so as to rotate said plunger between a locking position, in which said latch projection of said plunger engages said plunger engaging groove in said shorter leg portion and in which said locking unit engages said ball retaining groove in said longer leg portion to arrest upward movement of said longer and shorter leg portions against action of said biasing spring in order to prevent removal of said shorter leg portion from said second shackle insert hole, and an unlocking position, in which said latch projection is disengaged from said plunger engaging groove in said shorter leg portion, and said longer leg portion is moved relative to said locking unit due to the action of said biasing spring for disengaging said locking unit, thereby permitting removal of said shorter leg portion from said second shackle insert hole;

wherein said lock base is further formed with a fastener hole which extends transversely between said first shackle insert hole and said lock receiving space below said ball chamber, said lock base having a surrounding wall between said top and bottom sides and formed with an access bore that extends into said first shackle insert hole and that is aligned with said fastener hole, said padlock further comprising a fastener unit received in said fastener hole and having one end engaging said lock device so as to prevent removal of said lock device from said lock receiving space, said fastener unit being operable by means of a tool that extends into said fastener hole via said access bore to permit removal of said lock device from said lock receiving space when said longer legs portion disengages said locking unit.

2. The padlock according to claim 1, wherein said fastener unit includes a nut disposed within said fastener hole, and a screw bolt extending threadedly through said nut and having one end that engages said lock device, said screw bolt being operable by means of the tool so that said one end is moved away from said lock device in order to permit removal of said lock device from said lock receiving space when said longer leg portion disengages said locking unit.

3. The padlock according to claim 1, wherein said locking unit includes more than one ball member.

* * * * *